US009987511B2

(12) United States Patent
Bucher et al.

(10) Patent No.: US 9,987,511 B2
(45) Date of Patent: Jun. 5, 2018

(54) GAIT TRAINING APPARATUS

(71) Applicant: Hocoma AG, Volketswil (CH)

(72) Inventors: Rainer Bucher, Wettswil (CH); Gery Colombo, Uster (CH); Lijin Aryananda, Zurich (CH); Andreas Koll, Zurich (CH)

(73) Assignee: Hocoma AG, Volketswil, OT (CH)

( * ) Notice: Subject to any disclaimer, the term of this patent is extended or adjusted under 35 U.S.C. 154(b) by 315 days.

(21) Appl. No.: 14/441,586

(22) PCT Filed: Nov. 8, 2013

(86) PCT No.: PCT/EP2013/073371
§ 371 (c)(1),
(2) Date: May 8, 2015

(87) PCT Pub. No.: WO2014/072462
PCT Pub. Date: May 15, 2014

(65) Prior Publication Data

US 2015/0306440 A1 Oct. 29, 2015

(30) Foreign Application Priority Data

Nov. 9, 2012 (EP) ..... 12191933

(51) Int. Cl.
*A63B 24/00* (2006.01)
*A63B 15/02* (2006.01)
(Continued)

(52) U.S. Cl.
CPC ..... *A63B 21/00181* (2013.01); *A61H 3/008* (2013.01); *A61H 3/04* (2013.01);
(Continued)

(58) Field of Classification Search
USPC ..... 482/1–9
See application file for complete search history.

(56) References Cited

U.S. PATENT DOCUMENTS 5,569,129 A 10/1996 Seif-Naraghi et al.
6,689,075 B2 * 2/2004 West ..... A61F 5/0102 482/69
(Continued)

FOREIGN PATENT DOCUMENTS

CA 2828420 A1 9/2012
CN 2400094 Y 10/2000
(Continued)

OTHER PUBLICATIONS

WO 2012107700 A2 Translation.*
(Continued)

*Primary Examiner* — Andrew S Lo
*Assistant Examiner* — Shila Jalalzadeh Abayne
(74) *Attorney, Agent, or Firm* — Seyfarth Shaw LLP; Brian Michaelis

(57) ABSTRACT

An apparatus for gait training, comprising: a movable base (11) comprising a drive unit (13) for moving the movable base (11), an arm arrangement (15, 16, 18) extending from the movable base (11) to enable a person (113) to be at least partially suspended from above, a movement detector (14, 115; 20; 21) to detect a movement of the person (113), and a control unit (119) configured to control said drive unit (13) in response to movement of the person detected by the movement detector (14, 115; 20; 21) such that the movable base (11) follows the person (113) in a predetermined distance range and in a predetermined angular range with respect to a movement direction of the person (113). The apparatus may comprise a projector (112) configured to project a path to be taken by the person (113) and a securing mechanism (21) to secure the suspension of the person (113) in response to a fall or stumbling being detected by a fall detector (21).

17 Claims, 6 Drawing Sheets

(51) Int. Cl.

| | |
|---|---|
| ***A63B 71/00*** | (2006.01) |
| ***A63B 21/00*** | (2006.01) |
| ***A61H 3/00*** | (2006.01) |
| ***A61H 3/04*** | (2006.01) |
| ***A63B 22/00*** | (2006.01) |
| ***A63B 22/02*** | (2006.01) |
| *A61G 7/10* | (2006.01) |

(52) U.S. Cl.

CPC ..... *A63B 22/0015* (2013.01); *A63B 22/0023* (2013.01); *A63B 22/0235* (2013.01); *A63B 24/0087* (2013.01); *A63B 71/0054* (2013.01); *A61G 7/1019* (2013.01); *A61G 7/1048* (2013.01); *A61G 7/1051* (2013.01); *A61G 2203/42* (2013.01); *A61H 2201/0176* (2013.01); *A61H 2201/0188* (2013.01); *A61H 2201/0192* (2013.01); *A61H 2201/1215* (2013.01); *A61H 2201/1621* (2013.01); *A61H 2201/1652* (2013.01); *A61H 2201/5007* (2013.01); *A61H 2201/5058* (2013.01); *A61H 2201/5061* (2013.01); *A61H 2201/5069* (2013.01); *A61H 2201/5092* (2013.01); *A61H 2201/5097* (2013.01); *A61H 2230/625* (2013.01); *A63B 2022/0092* (2013.01); *A63B 2220/18* (2013.01); *A63B 2220/803* (2013.01); *A63B 2220/805* (2013.01)

(56) References Cited

U.S. PATENT DOCUMENTS

| | | | | |
|---|---|---|---|---|
| 2005/0288157 | A1* | 12/2005 | Santos-Munne ..... | A61H 3/008 482/66 |
| 2007/0034243 | A1* | 2/2007 | Miller ..... | A61H 3/04 135/67 |
| 2008/0072942 | A1* | 3/2008 | Warren ..... | A61H 3/00 135/67 |
| 2008/0234113 | A1* | 9/2008 | Einav ..... | A61B 5/103 482/66 |
| 2009/0298653 | A1 | 12/2009 | Rodetsky et al. | |

FOREIGN PATENT DOCUMENTS

| | | | | |
|---|---|---|---|---|
| CN | 101458083 | A | 6/2009 | |
| CN | 201519429 | U | 7/2010 | |
| WO | 2000028927 | A1 | 5/2000 | |
| WO | 2011130223 | A1 | 10/2011 | |
| WO | 2012107700 | A2 | 8/2012 | |
| WO | WO 2012107700 | A2 * | 8/2012 | ..... A61H 3/008 |

OTHER PUBLICATIONS

Partial European Search Report for Application No. 16172206.1, dated Sep. 29, 2016.
Search Report for PCT/EP2013/073371.
Extended European Search Report, dated Nov. 25, 2016, Applicant: Hocoma AG, 10 pages.

* cited by examiner

GAIT TRAINING APPARATUS

The present invention relates to a gait training apparatus usable for example in gait therapy.

In recent years, there has been an increased interest in improving or automatizing gait therapy for patients, for example for stroke patients or other patients who have to learn or relearn how to walk or for any other patients with limited walking abilities.

From WO 2000/028927 A1 a device and method for automating treadmill therapy is known, where a patient is walking on a treadmill and may be partially or fully suspended, i.e. part or all of the weight of the patient may be borne by a load bearing device, which may be adjustable.

Such a device is in particular useful for early stages of therapy. However, as the patient is essentially fixed above the treadmill, not all of the complex movements needed for walking in daily life, for example climbing stairs, may be easily practiced with such a device.

For providing the possibility of a more flexible walking therapy, from U.S. Pat. No. 7,462,138 B2 it is known to provide a rail system on a ceiling of a building or on columns above a patient and to suspend the patient from such a rail system. This system allows for flexible walking within the area covered by the rail system. However, as the rail system is heavy and cumbersome, special rooms have to be provided for installing the rail system, and the therapy then has to take place in the thus equipped room. Therefore, flexible deployment of such an apparatus is limited.

It is therefore an object to provide a gait training apparatus which may be deployed in a flexible manner as regards the location of deployment and which enables a person using the apparatus to practice various kinds of walking movements.

According to an embodiment, an apparatus for gait training as defined in claim 1 is provided. The dependent claims define further embodiments.

According to an embodiment, an apparatus for gait training is provided, comprising:

a movable base, said movable base comprising a drive unit for moving the movable base, an arm arrangement extending from the base, a weight support system to enable a person to be at least partially suspended from above via the arm arrangement, a movement detector to detect a movement of the person, and a control unit configured to control said drive unit in response to movement of the person detected by the movement detector such that the movable base follows the person in a predetermined distance range and in a predetermined angular range with respect to a movement direction of the person.

With such an apparatus, a person, for example a patient, may be suspended from above, and as the movable base follows the person in the predetermined distance range, the person may walk essentially freely without being limited to any room having specific equipment.

The predetermined angular range may be user configurable and may be selected such that the movable base moves outside a movement path of the person and/or may pass obstacles. This e.g. allows the person to train using elements like obstacles, stairs, etc., while the movable base passes besides such elements. It is to be noted that the predetermined angular range may be changed during training, e.g. based on inputs by a patient or therapist, based on obstacles captured by a sensor and/or based on a stored predetermined pattern matching e.g. a certain training course.

The arm arrangement may comprise a vertical portion and a horizontal portion, the weight support system enabling the person to be suspended from the horizontal portion. A length of the vertical portion may be adjustable for example to adjust the apparatus to persons of different sizes, or to accommodate the person walking on non-even surfaces like stairs.

The movable base may comprise a single base unit, but also may comprise more than one base unit in some embodiments.

The arm arrangement may comprise an adaptation mechanism to adapt a horizontal distance between a point where the person (113) is suspended at the arm arrangement (15, 16, 18; 15A, 16A, 15B, 16B; 18A, 18B) and said movable base (11; 11A, 11B) to movements, in particular small movements, of the person on the ground, while larger and/or slower movements may be accommodated by controlling the drive unit to move the movable base.

The movable base may comprise wheels, for example omnidirectional wheels like so-called Swedish wheels, sometimes also referred to as Mecanum wheels. The apparatus may also comprise a projector to project for example a walking course on the ground in front of the person.

The sensor may comprise for example an optical sensor, an ultrasonic sensor, an infrared sensor and/or the like. In some embodiments, the sensor may be partly or completely provided in the movable base. In some embodiments, the sensor may comprise a sensor part to be attached to the person, for example a transponder or reflector. In other embodiments, the sensor may comprise an angular sensor sensing an angle of a rope used to suspend the person and detect a movement of the person based on the detected angle and/or changes thereof.

In some embodiments, the apparatus may comprise a fall detector to detect a falling or stumbling of the person, and the control unit may be configured to take appropriate safety measures in case a falling or stumbling is detected, for example a braking operation or an extension of leg elements to improve the stability of the movable base. Such a falling or stumbling of a person may for example be detected by monitoring a force exerted on a rope suspending the person.

The apparatus may further comprise a hand-held device via which the person may control the apparatus, for example specific functions of the apparatus like emergency stop, or to select therapy modes for performing a therapy.

In some embodiments, the apparatus may comprise an additional arm arrangement configured to suspend for example an orthesis device to support movement of the person.

In another embodiment, an apparatus for gait training is provided, comprising:

a movable base, said movable base comprising a drive unit for moving the movable base, an arm arrangement extending from the movable base, a weight support system to enable a person to be at least partially suspended from above via said arm arrangement, a movement detector to detect a movement of the person, a control unit configured to control said drive unit in response to movement of the person detected by the movement detector and a projector mounted on the apparatus configured to project a path to be taken by the person.

The above-described features may be used singly or in combination with each other in various embodiments.

In the following, more detailed embodiments of the invention will be described with reference to the attached drawings.

In the following, various embodiments of the invention will be described in detail with reference to the attached drawings. It should be noted that the embodiments are given only for illustration purposes and are not to be construed as limiting the scope of the invention. Features of various embodiments described in the following may be combined with each other unless specifically noted otherwise. On the other hand, describing an embodiment with a plurality of features is not to be construed as indicating that all those features are necessary for practicing the invention, as other embodiments may comprise less features and/or alternative features.

In the following, apparatuses usable for gait training, in particular therapeutical gait training to assist a patient for example in (re)learning to walk after a stroke or other physical impairment, are described. In particular, embodiments described in the following are able to suspend a person at least partially, i.e. to bear part or all of the weight of the patient, such that the load acting on joints and muscles of the patient is reduced.

Figure 1:
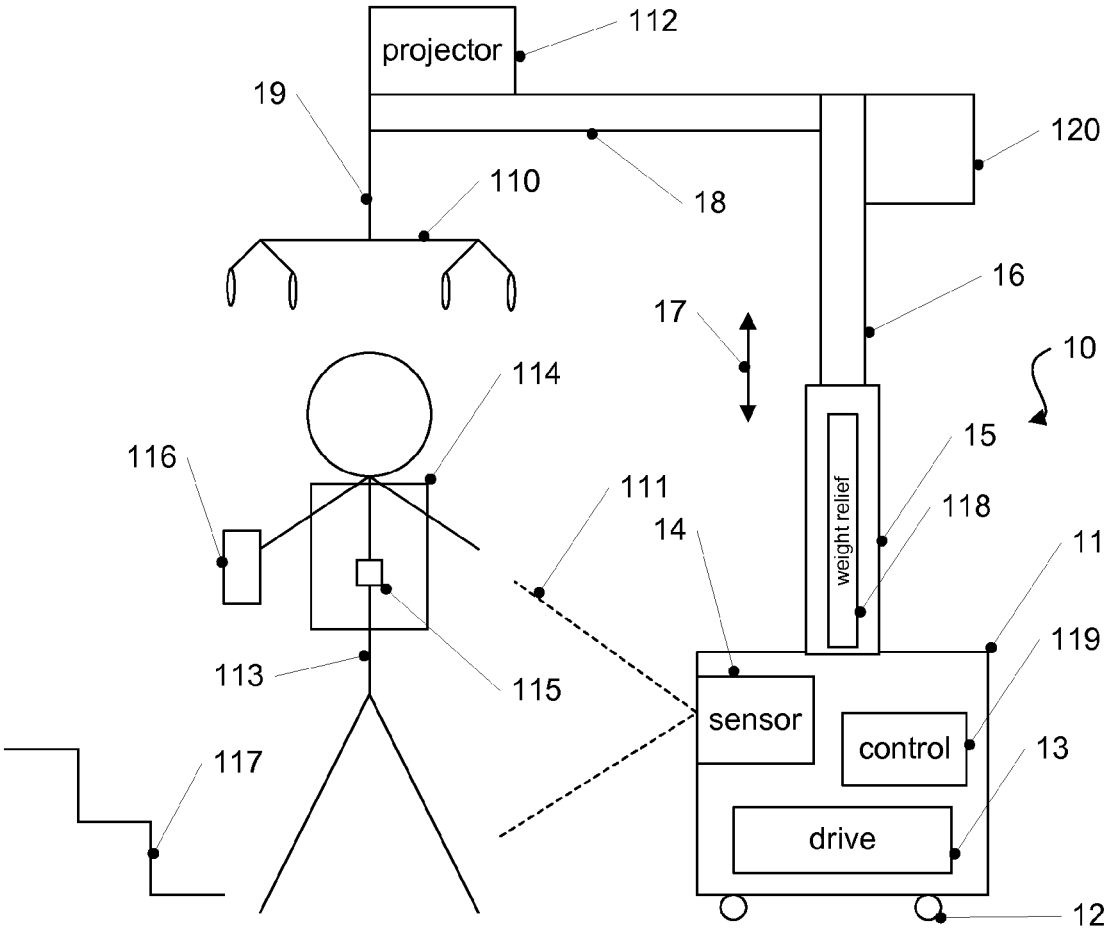
FIG. 1 is a schematic diagram showing an apparatus according to an embodiment.

In FIG. 1, an apparatus 10 according to an embodiment for gait training of a person 113 is shown.

The apparatus shown in FIG. 1 comprises a movable base 11 having wheels 12 to be able to roll on a floor or other horizontal surface. Mounted on base 11 is an arm arrangement comprising a lower vertical portion 15, an upper vertical portion 16 and a horizontal portion 18, such that the arm arrangement in the embodiment of FIG. 1 has a crane shape. At an end portion of horizontal portion 18 opposite an end portion coupled to upper vertical portion 16, a coupling arrangement 110 is suspended on a rope 19. Coupling arrangement 110 may be coupled for example with a harness 114 person 113 is wearing such as to fully or partially suspend person 113. A partial suspension in this respect refers to a case where only a part of the weight of person 113 is borne by apparatus 10.

In order to adjust the degree of suspension of person 113 and/or to adapt apparatus 10 to persons 113 of different weight, a weight relief mechanism 118 is provided and coupled to rope 19 for example via a pulley mechanism. With weight relief mechanism 118 the weight relief, i.e. the amount of weight of person 113 borne by apparatus 110, may be adjusted. A suitable weight relief mechanism is for example described in applicant's EP 1 586 291 A1 or EP 2 076 229 A1 in detail and will therefore not be described in detail again. In embodiments, it is generally preferable to locate at least heavier parts of weight relief mechanism 118 in or close to base 11, for example in lower vertical portion 15 as shown, to increase the stability of apparatus 10.

Apart from the weight relief mechanism described in the above-mentioned documents, also other mechanisms may be used, for example based on elastic elements like springs between lower vertical portion 15 and upper vertical portion 16.

As indicated by an arrow 17, generally upper vertical portion 16 may move inside lower vertical portion 15 for example for height adjustment to persons 113 of various heights or also for height adjustment when for example person 113 walks over an uneven surface like stairs 117. Such a height adjustment may be performed automatically during walking of person 113, for example by measuring a force on rope 19 and increasing the height when the force decreases and decreasing the height when the force increases. It should be noted that in other embodiments additionally or alternatively such a height adjustment may be performed by adjusting an amount of rope length issued from horizontal portion 18 to person 113.

Furthermore, in the embodiment of FIG. 1 movable base 11 comprises a drive 13 for driving and steering wheels 12, drive 13 being controlled by a control unit 119. Control unit 119 receives signals from a sensor 14 which, as indicated by dashed lines 111, monitors movements of person 113 and informs control unit 119 thereof. In response to movements detected via sensor 14, control unit 119 controls drive 13 to drive and/or steer wheels 12 to follow person 113, such that the distance between base 11 and person 113 remains at least approximately constant, i.e. within a predetermined distance range. In this way, person 113 may move around essentially freely on various surfaces like stairs 117, inclined surfaces, uneven surfaces including e.g. a trampoline, balance objects or across obstacles. Base 11 and therefore the complete apparatus 10 is then following person 113 and thus enabling a gait therapy using essentially arbitrary walking movements. Furthermore, the following of person 113 is such that apparatus 10 remains positioned in a predetermined angular range with respect to a movement direction of person 113. In other words, base 11 may remain positioned essentially in the same direction relative to person 113, for example always on a left side, always behind, always on the right side, etc. To allow for angular tolerance, for example upper vertical portion 16 may be rotatable within lower vertical portion 15, or horizontal portion 18 may be rotatable around upper vertical portion 16, i.e. about a vertical axis, such that the arm arrangement can follow circular movements of person 113 around base 11. This will be explained in some more detail with reference to FIG. 8 further below.

Various types of sensors may be employed for sensor 14. It should be noted that also various types of sensors may be employed concurrently, to create a redundancy in monitoring the movement of person 113. For example, sensor 14 may be an optical sensor, for example comprising one or more cameras, in which case movement of person 113 may be determined via an image analysis which may be performed by control unit 119 or by a dedicated image processor. In other embodiments, sensor 14 may comprise one or more ultrasonic sensors or infrared sensors. In some embodiments, to determine position and movement of person 113 person 113 may wear a sensor component 115, for example a reflector, transponder or receiver to reflect or receive signals, for example ultrasonic signals, sent by sensor 14. Sensor component 115 in case of a receiver may then send back information about the received signals to sensor 14, for example via radio frequency waves. Instead of a single sensor element 115, also a plurality of such elements may be provided on person 113 to more precisely determine a movement of this person. Also, inertial measurement units may additionally be provided to determine the posture of person 113. A suitable system for motion detection using ultrasonic sensors is for example described in US 2008/0223131 A1.

It should be noted that while sensor 14 is depicted as being incorporated in base 11, sensor 14 may also be located at other parts of apparatus 10, for example on the arm arrangement 15, 16, 18. In still other embodiments, sensor 14 may be external to apparatus 10 and may for example comprise a camera arrangement for monitoring person 113 and apparatus 10 and their relative position to each other and transmitting corresponding information to base 11. In a similar manner, also control unit 119 may be an external computing device communicating with an appropriate sensor and drive 13 for example via wireless signals. A further possibility for detecting movement of person 113 will be described later with reference to FIG. 2.

In some embodiments, the apparatus may further comprise a hand-held device 116 or be configured to communicate with a hand-held device. Hand-held device 116 may be a dedicated hand-held device (for example also comprising simple mechanical elements like a button or a joystick) or also a general purpose programmable hand-held device like a smartphone with a corresponding application and may communicate e.g. with control unit 119 in a wireless manner or via a wire-based connection. Via hand-held device 116, for example an emergency stop may be initiated (for example causing apparatus 10 to bear the complete weight of person 113), a desired therapy program (e.g. stair climbing, standing up from a sitting position, walking around, etc.) may be selected, parameters like a degree of weight relief may be adjusted and/or for example a height adjustment by moving upper vertical portion 16 relative to lower vertical portion 15 may be performed. Also, feedback may be given to person 113 via hand-held 116, for example regarding training duration or completion of specific tasks like climbing a stair like stair 117 or regarding correctness of movement of person 113. In some embodiments, dedicated sensors may be used to evaluate the correctness, e.g. quality, of the movement, e.g. gait, of person 113. In other embodiments, sensor 14 or another corresponding sensor used for detecting movements of person 113 to enable movable base 11 to follow person 113 may be also used for this purpose. In some embodiments, instead of hand-held 116 an input device fixed to apparatus 10 or any other external input/output device like a computer connected to apparatus 10 in a wireless manner may be additionally or alternatively used. It should be noted that other embodiments may work without using a hand-held device. Also, an emergency stop may be implemented additionally or alternatively based on a monitoring of person 113, for example via sensor 14. When an emergency, for example a falling of person 113, is detected, an emergency stop e.g. as explained above is performed. Such an automatic emergency stop may enable an unsupervised training of person 113.

In some embodiments, apparatus 10 may additionally comprise a projector 112 which may be mounted on horizontal portion 18 or on any other suitable location of apparatus 10, e.g. on movable base 11 or on vertical portions 15 or 16. Projector 112 may be used to project a path on the floor in front of person 113 which person 113 then has to follow. Through movement detection via sensor 14 it may be ascertained how precise person 113 follows the projected path, and feedback may be given to person 113 via hand-held device 116, just to give an example. Such a projected path may for example be depicted as continuous or discrete objects. It may for example comprise curves or narrow portions to stimulate different movements of person 113, such movements being for example movements of a whole body of person 113 or only of the legs and/or feet of person 113. The path may for example be indicated by a set of visual objects onto which the person has to touch, e.g. has to step with his/her feet, or in another example by a set of visual objects the person must not touch, e.g. onto which the person must not step with his/her feet. In an embodiment, the visual objects may comprise a visualization of a set of stones sticking out of a pool indicating a path where the person has to place the feet onto the stones. Other representations, for example more abstract representations, are equally possible.

It should be noted that in other embodiments projector 112 may be omitted.

Furthermore, in the embodiment of FIG. 1, a counter weight 120 is provided on upper vertical portion opposite horizontal portion 18 to increase stability. In other embodiments, counter weight 120 may be omitted provided that e.g. base 11 is heavy enough to provide a desired stability. In yet other embodiments, counter weight 120 may be provided at a different location. One example for such a different position will be explained later with reference to FIG. 7.

Further optional features and variations of apparatuses according to embodiments will be described next with respect to FIG. 2-7.

Figure 2:
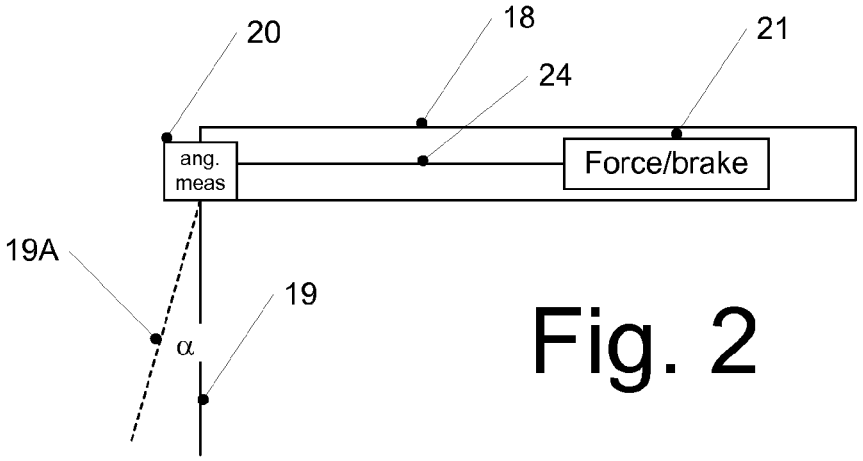
FIG. 2 shows a partial view including a vertical arm portion of an apparatus according to an embodiment.

In FIG. 2, a horizontal portion 18 is shown, for example horizontal portion 18 of the arm arrangement of FIG. 1, which comprises an angular measurement unit 20 to detect movement of a person suspended by a corresponding apparatus. This angular measurement device 20 may for example be provided instead of sensor 14 of FIG. 1, but may also be provided in addition thereto. Angular measurement unit 20 measures an angular position and/or movement of rope 19 at which a person is suspended, which angular movement may for example be caused by a movement of the person while apparatus 10 of FIG. 1 remains stationary. For example, when the person moves, the rope may move to a position 19*a*, thus forming an angle $\alpha$ to the vertical position 19. The amount of movement can then be calculated based on $\alpha$ using a known (for example previously inputted or measured) height of the person suspended on rope 19. Details of movement detection via such an angular measurement unit, for example a dual tilt angle sensor, are shown in the above-mentioned U.S. Pat. No. 7,462,138 B2. Additionally or alternatively, an amount of rope length issued from horizontal portion 18 to accommodate a movement of person 113 may be evaluated to detect a movement. In still other embodiments, a tension of the rope may be measured and evaluated. For example, in weight relief mechanisms as in the above-mentioned EP 1 586 291 A1 or EP 2 076 229 A1, a length of a rope is essentially fixed, and dynamic loading/unloading of the person's weight is performed by adjusting rope tension. In such cases, also a change of rope tension may be evaluated to detect movements. Based on such detected movement, drive 13 of base 11 may be controlled to follow person 113.

Additionally, an apparatus in some embodiments may comprise a force/brake mechanism 21 acting on a continuation rope part 24 of rope 19 (rope part 24 may for example be linked to rope 19 via a pulley). While force/brake mechanism 21 is schematically shown in horizontal portion 18 in FIG. 2, it may also be incorporated in weight relief mechanism 118 of FIG. 1 or placed elsewhere in the apparatus. Force/brake mechanism 21 monitors a force on rope 19, and under certain circumstances for example secures the rope. For example, a sudden rapid increase in force or in rope length issued by horizontal portion 18 may indicate a stumbling or falling of the person, in which case a fixing of the rope prevents the person performing the training from falling further. In some embodiments, a mechanism similar to a seat belt may be used. While falling or stumbling of person 113 in the embodiment of FIG. 2 is detected via a force acting on rope 19, in other embodiments falling or stumbling of person 113 may be detected in a different manner, for example via an optical sensor using image analysis. In case such an optical sensor is used, it may be the same optical sensor which is also used for detecting movement of the person, for example sensor 14 of FIG. 1. In still other embodiments, a stumbling or falling may detected via the movement detection performed by angular measurement device 20, for example when a change rate of the measured angle exceeds a predetermined threshold. In yet other embodiments, a stumbling or falling may be detected by detecting a corresponding acceleration of person 113 via a sensor mechanically coupled with person 113, for example an inertial measurement unit.

Figure 3:
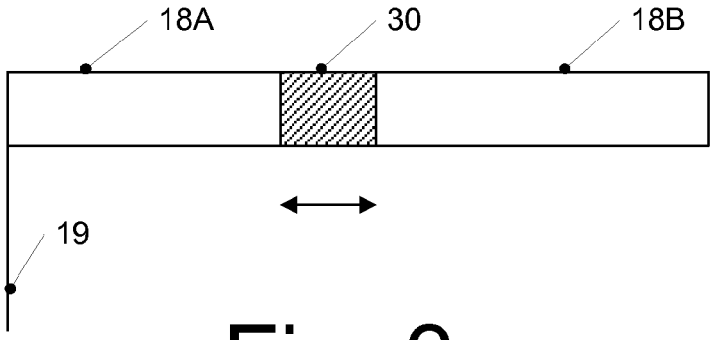
FIG. 3 shows a partial view including a vertical arm portion of an apparatus according to an embodiment.

A further optional additional feature is shown in FIG. 3. In FIG. 3, a horizontal portion of an arm arrangement comprises a first part 18A and a second part 18B which are linked by an extendable portion 30, via which the overall length of the horizontal portion may be increased or decreased. Such an extendable portion 30 may assist the ability of apparatus 10 to follow quick movements of person 113, as in many implementations base 11 may rather be heavy to provide stability and therefore has a high inertia, which makes it more difficult to follow quick movements. Therefore, an extendable portion 30, possibly together with a rotatable horizontal portion as already described with reference to FIG. 1, may assist in accommodating movements on short time scales, until for example drive 13 drives base 11 to follow the movement. Extendable portion 30 may comprise a passive mechanism like a spring mechanism, but may also comprise active mechanism where extension and retraction of extendable portion 30 in e.g. driven by a motor and controlled e.g. by control 119 of FIG. 1 based on a detected movement of person 113 by sensor 14 of FIG. 1. Besides extendable portion 30, also other adaptation mechanisms for adapting a horizontal distance between a point where person 113 is suspended at the arm arrangement (the point where rope 19 exits horizontal portion 18 in FIG. 1) and base 11 to movements, in particular small and/or quick movements, of person 113 may be provided. For example, in an embodiment the point where rope 19 exits horizontal portion 18 may be moved, e.g. by moving a pulley guiding rope 19.

Figure 4:
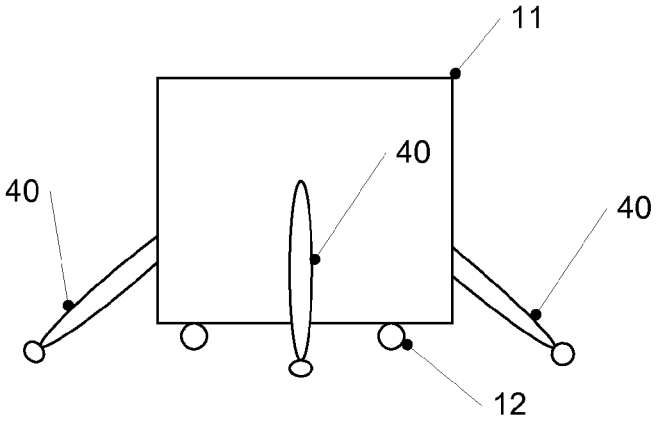
FIG. 4 shows a partial view including a movable base of an apparatus according to an embodiment.

A further optional feature implementable in some embodiments is shown in FIG. 4. Here, a base 11 may comprise extendable and retractable legs 40. In case for example via a force sensor like force/brake mechanism 21 of FIG. 2 a falling or stumbling of a person doing therapy is detected, legs 40 may extend to increase the stability of the base. When therapy is resumed, legs 40 may be retracted again.

While three legs 40 are shown in FIG. 4, the number of legs is not limited to any particular number.

Figure 5:
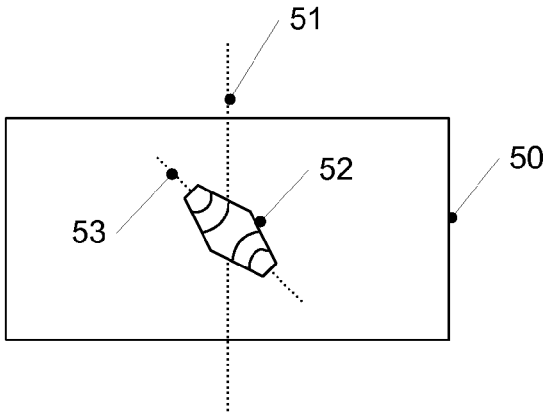
FIG. 5 is a view of a wheel usable for a basis in some embodiments.

Wheels 12 of base 11 may take any suitable form to move and steer base 11 and thus apparatus 10 of FIG. 1. In some embodiments, wheels of a base may be omnidirectional wheels, i.e. wheels which may move in any direction. One example for such omnidirectional wheels are so-called Swedish wheels, sometimes also referred to as Mecanum wheels or Ilon wheels. A simple example for such a wheel is shown in FIG. 5. The wheel of FIG. 5 comprises a main wheel body 50 rotatable about a main axis 51. On a tread surface of main wheel body 50 a plurality of subwheels 52 (one of which is shown) rotatable about a sub-axis 53 are provided. In the example shown, sub-axis 53 form an angle of about 45 degrees with main axis 51, bit other angles, e.g. 90 degrees, are equally possible. By a suitable combination of rotation of subwheels 52 and main wheel body 50, the wheel may move essentially in any desired direction. Other type of omnidirectional wheels as well as conventional wheels are equally usable.

It is emphasized that the various optional features discussed above with reference to FIG. 2-5 may be used in combination of two or more of these features or also singly in the embodiment of FIG. 1 or in other embodiments of training apparatuses.

Figure 6:
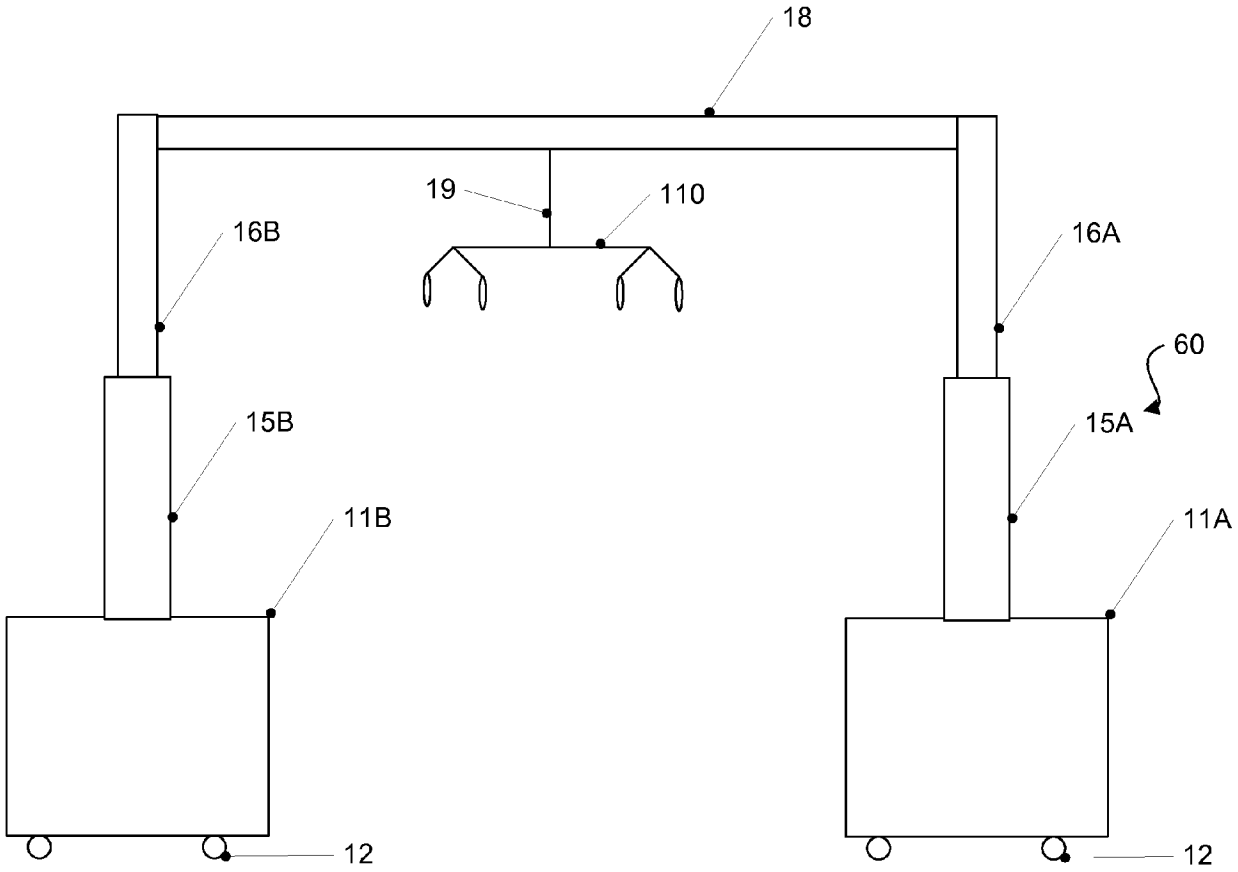
FIG. 6 shows a schematic view of an apparatus according to a further embodiment.

In the apparatus 10 of FIG. 1, a single unit serves as base 11. In other embodiments, more than one unit may be provided serving as a base. Providing a base comprising several units generally tends to increase the stability of the apparatus, but also makes the apparatus more bulky and less flexible to use. An example of an apparatus 60 according to an embodiment having a base comprising two base units 11A, 11B is schematically shown in FIG. 6. Each of base units 11A, 11B is movable on wheels 15. On base units 11A and 11B an arm arrangement is provided comprising a first lower vertical portion 15A and first upper vertical portion 16A on base unit 11A, a second lower vertical portion 15B and a second upper vertical portion 16B on base unit 11B and a horizontal portion 18 between first upper vertical portion 16A and second upper vertical portion 16B. A patient may be suspended on rope 19 having a coupling arrangement 110 as already explained with reference to FIG. 1. One or both of bases 11A, 11B may comprise a drive together with a control unit. In case both base units 11A, 11B comprise a drive unit, a single control may be provided, or two control units coordinating each other for example via wireless signals may be provided. Also, one or both of base units 11A and 11B may comprise a sensor like sensor 14 of FIG. 1. Other features and operating details of apparatus 60 may be the same as described for apparatus 10 of FIG. 1 with reference to FIG. 1-5 and will therefore not be repeated again for the apparatus 60 of FIG. 6. It should be noted that while the embodiment of FIG. 6 may have increased stability, generally embodiments using a single base unit are more flexible as regards their use as they require less space.

Figure 7:
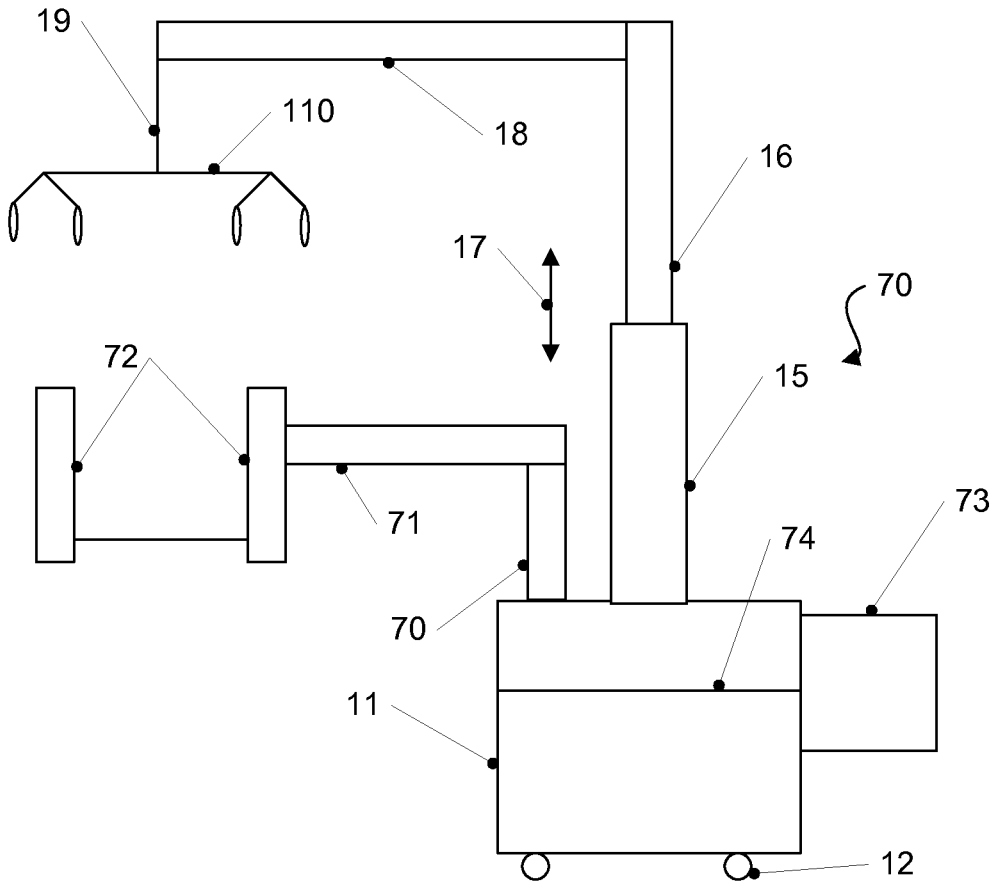
FIG. 7 shows a schematic view of an apparatus according to another embodiment.

A further embodiment of an apparatus 70 is shown in FIG. 7.

Apparatus 70 of FIG. 7 comprises a base 11 on wheels 12, an arm arrangement with a lower vertical portion 15, an upper vertical portion 16 and a horizontal portion 18 from which a rope 19 with a coupling arrangement 110 extends, as already described with reference to FIG. 1. Therefore, these elements will not be described again. Furthermore, all additional and optional features described with reference to FIG. 1-6 including the provision of additional base units discussed with reference to FIG. 6 may also be used in apparatus 70 of FIG. 7 and will therefore also not be described again.

Apparatus 70 comprises a counter weight 73 mounted to base 11 and movable around base 11 using e.g. tracks 74 or another mechanism such that counter weight 73 does not interfere with movement of a person training and/or is generally on the opposite side of horizontal portion 18. In other embodiments, counter weight 73 may be provided inside base 11.

Apparatus 70 of FIG. 7 furthermore comprises a further arm arrangement comprising a vertical portion 70 and a horizontal portion 71 to which an orthesis device 72 is mounted. Orthesis device 72 may additionally support the walking therapy by guiding the limbs, in particular the legs, of the person training with apparatus 17. Orthesis device 72 may comprise motors for this purpose, i.e. for guiding and moving the limbs of the person training accordingly. The use of orthesis devices in walking therapy is for example described in the already mentioned WO 2000/028927 A1 of the applicant. It should be noted that in other embodiments, for example so-called exolegs may be used together with an apparatus according to an embodiment, the exolegs not necessarily being linked to the apparatus by a further arm arrangement or similar components.

With respect to FIG. 1-7, various embodiments have been described where an apparatus follows a person undergoing therapy by detecting movement of the person. As already mentioned, this following in embodiments is performed such that a movement path of the person is not obstructed to enable the person to perform various exercises. This will be further illustrated with respect to FIG. 8.

Figure 8:
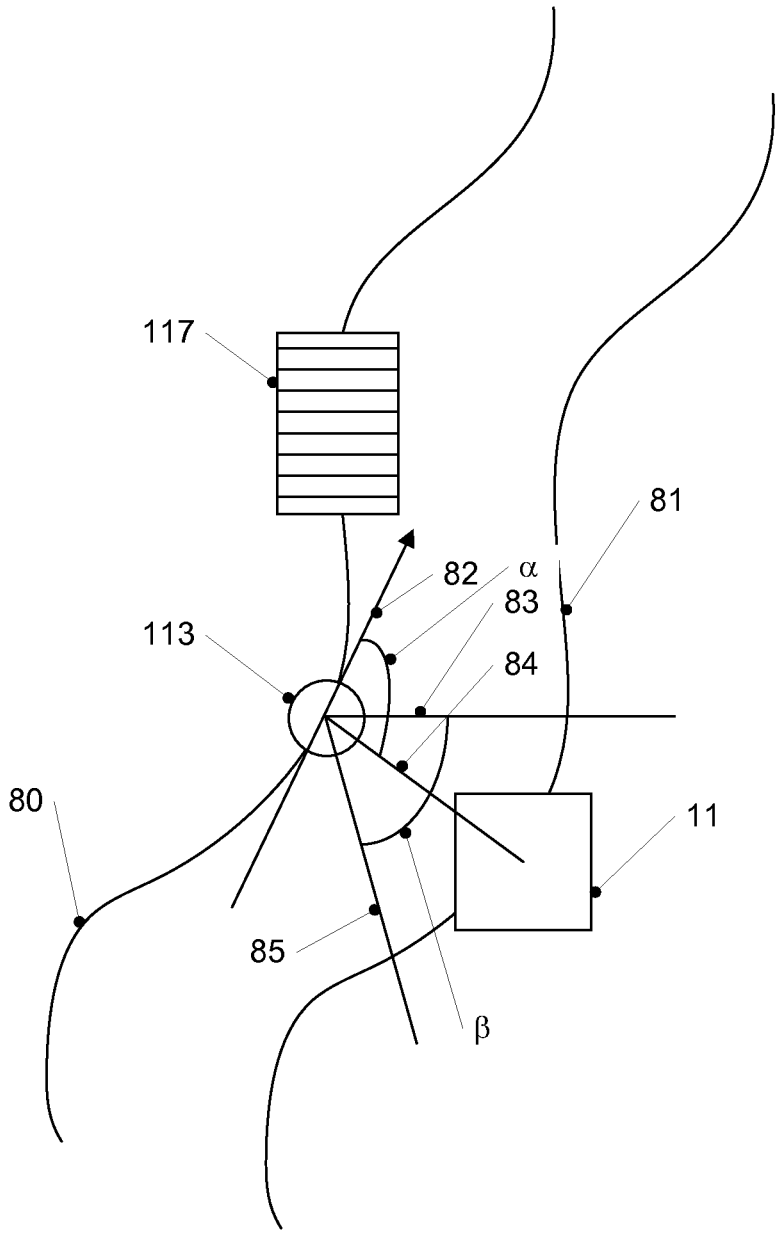
FIG. 8 shows an explanatory top view of an apparatus according to an embodiment.

In FIG. 8, an apparatus according to an embodiment, for example the apparatus of any one of FIG. 1-7, is represented by its base 11, and the person 113 suspended on the apparatus is represented by a circle. Further components of the apparatus as previously described are not explicitly shown in FIG. 8 for a clearer representation.

In the example shown, person 113 follows a movement path 80, which may lead over various training elements like stairs 117 or other obstacles, trampolines or the like. By using the mechanisms above, base 11 and thus the training apparatus follows person 113 in a predetermined distance range, represented by a distance 84 in FIG. 8. It should be noted that the predetermined distance range may be explicitly given by defining a minimum distance and a maximum distance, or may be defined by a single distance, deviations from this distance which regularly occur for example due to inertia of the apparatus, thus leading to a certain distance range around the desired distance. Furthermore, as also explained previously base 11 and thus the training apparatus is configured to follow person 113 within a predetermined angular range with respect of a movement direction of person 113. The movement direction in FIG. 8 is represented by an arrow 82 and for example essentially corresponds to a tangent of movement path 80 at a location of person 113. In the example of FIG. 8, base 11 is positioned at an angle $\alpha$ with respect to the movement direction 82, which is within an angular range relative to movement direction 82 limited by lines 83, 85 defining an angle $\beta$. Therefore, base 11 in the example of FIG. 8 essentially moves on a movement path 81 and thus for example passes besides stairs 107 or other elements in movement path 80, thus enabling the corresponding training of person 113.

Similar to the predetermined distance range, also the predetermined angular range may be defined by determining a maximum and a minimum angle (for example corresponding to lines 83 and 85 of FIG. 8) or by defining a single desired angle (for example angle $\alpha$ in FIG. 8), which then may be slightly varied within a certain range based on mechanical limitations like inertia of base 11 or the corresponding apparatus.

As already mentioned, the predetermined angular range may be user configurable in some cases, such that base 11 may for example be configured to move at a side of person 113 (right side or left side), at a side and behind person 113 or directly behind person 113, which may also be selected depending on the exercises to be performed. In some cases, the predetermined angular range may change during a training depending on the circumstances, e.g. depending on exercises to be performed or a path to be taken by person 113. An example for a varying predetermined angular range is shown in FIG. 9.

Figure 9:
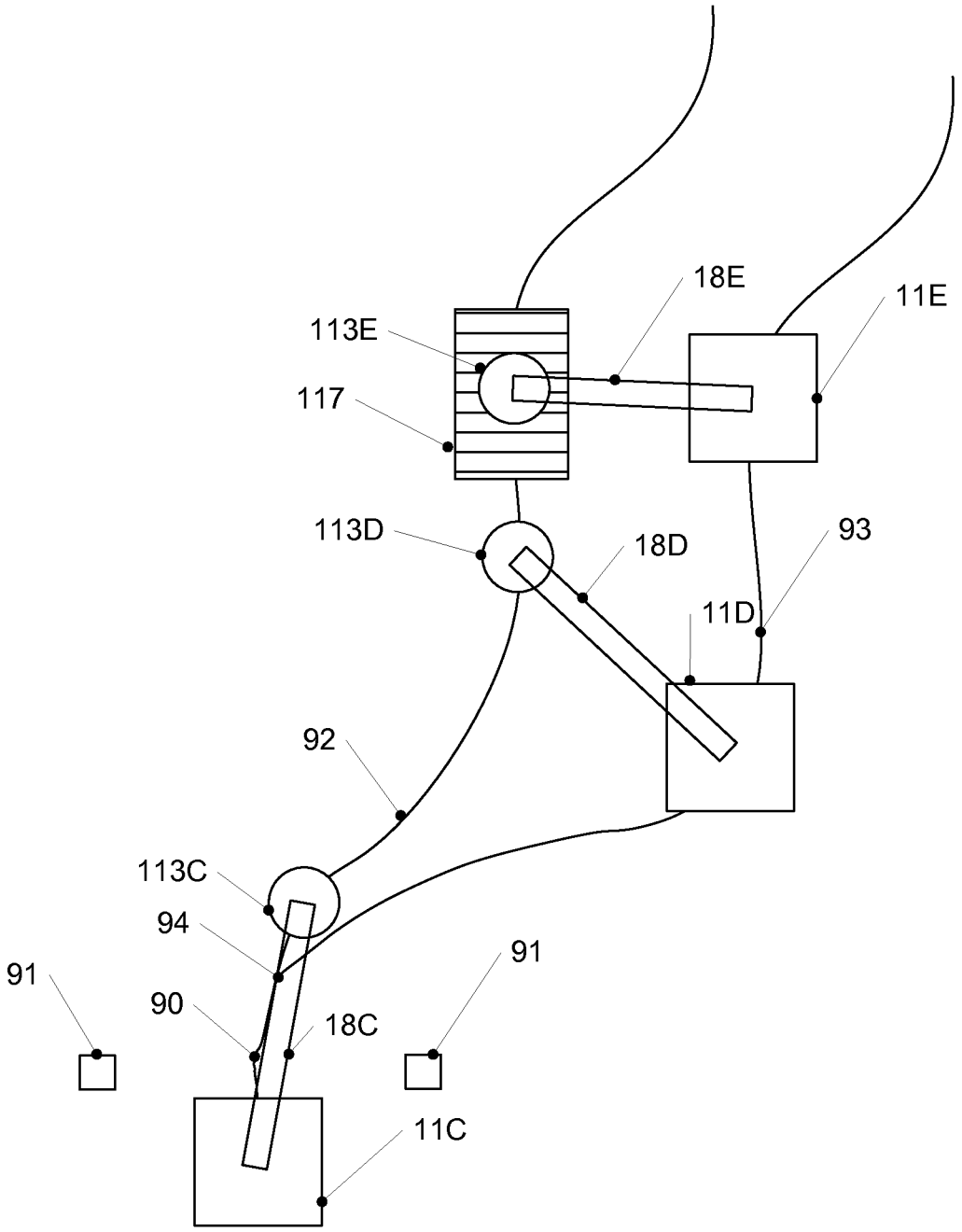
FIG. 9 shows a further explanatory top view of an apparatus according to an embodiment.

In the example of FIG. 9, person 113 first has to pass through a door 91. In order to enable base 11 to also pass through door 91, here the predetermined angular range may be set such that base 11 follows behind person 113. This is shown as an example for person 113C and base 110 in FIG. 9. In other words, in the example of FIG. 9 e.g. up to a point 94 person and base may follow the same path. Then, the predetermined angular range may be changed such that base 11 follows person 113 in an angle about 45° behind person 113, as shown as an example for person 113D and base 11D in FIG. 9. When person 113 then trains by climbing stairs 117, the predetermined angular range may be adjusted such that base 11 moves directly besides person 113, as shown for person 113E and base 11E. In such an example, from point 94 person 113 follows path 92, while base 11 follows path 93. When the predetermined angular range changes, the arm arrangement may be pivoted accordingly, as shown in FIG. 9 in an exemplary manner for arm arrangements 18C, 18D and 18E, respectively.

Such changes in the predetermined angular range may for example be caused by a user input, for example by person 113 or by a therapist supervising the training of person 113. In other embodiments, additionally or alternatively a sensor like optical sensor 14 or a dedicated sensor for obstacle detection may sense obstacles like door 91 or stairs 117 or other obstacles in the path of base 11 and/or an arm arrangement mounted on base 11 and adjust the predetermined angular range accordingly to avoid collisions. It should be noted that in some embodiments, when an obstacle is detected in this way and avoiding the obstacle is not possible due to space restraints (or in an embodiment where the predetermined angular range is not changeable based on obstacle detection), an emergency stop as explained already above may be performed.

It should be noted that a certain training course or training path, for example comprising stairs 117 or other obstacles, may for example be stored in a control unit like control unit 119 of the apparatus, or a sensor, for example sensor 14 or a dedicated sensor, may recognize the training course and elements thereof. Control unit 119 may then control the apparatus depending on the predetermined or recognized (via sensors) training course. For example, when person 113 climbs stairs, the height for example of vertical portions 15, 16 may be adjusted automatically, or the weight relief 118 may be adjusted to actively support the person when climbing the stairs, for example actively lifting the person. For other exercises, for example more slack of rope 19 may be desired, and this may also be controlled automatically. In case of a predetermined training course stored e.g. in a memory, also predetermined angular ranges for various parts of the training course may be stored.

Further variations not explicitly shown in the drawings are also possible. For example, while arm arrangements comprising vertical portions and horizontal portions are depicted, other arrangements are also possible, for example arm arrangements comprising portions running at an acute angle with respect to a surface of base 11 and/or a surface on which base 11 stands. Also, horizontal portion 18 may comprise two or more parts linked for example by hinges or other joints, and vertical portions may comprise more than two parts or only a single part. In general, every form of arm arrangement can be used as long as the person training may be suspended from above.

While embodiments with single base units and two base units are shown, also more base units are possible.

The invention claimed is:

1. An apparatus for gait training, comprising:

a movable base, said movable base comprising a drive unit for moving the movable base on a ground or floor surface;

an arm arrangement extending from the movable base;

a weight support system coupled to the arm arrangement and configured to support a person at least partially suspended from above via said arm arrangement;

a movement detector configured to detect a movement of the person; and a control unit communicating with the movement detector and configured to control said drive unit, wherein in response to movement of the person detected by the movement detector, the control unit controls the drive unit such that the movable base follows the person in a predetermined distance range and in a predetermined angular range with respect to a movement direction of the person, and wherein the predetermined angular range is selected such that the movable base follows a moving path of the person in another path different from the moving path of the person to enable the person to use training elements including obstacles and stairs.

2. The apparatus of claim 1, further comprising a projector configured to project a path to be taken by the person.

3. The apparatus of claim 2, wherein the projector is configured to project the path comprising one or more elements from the group consisting of a curve, a visual object to be touched by the person, a visual object not to be touched by the person, and a narrow portion.

4. The apparatus of claim 2, wherein the projector is configured to project the path on the floor in front of the person.

5. The apparatus of claim 1, further comprising a fall detector to detect a stumbling and/or falling of the person.

6. The apparatus of claim 5, further comprising a securing mechanism to secure the suspension of the person in response to a fall or stumbling being detected by the fall detector.

7. The apparatus of claim 5, wherein the movable base further comprises extendable legs which are extended in response to a fall or stumbling being detected by the fall detector.

8. The apparatus of claim 1, further comprising a hand-held device enabling the person to control the apparatus.

9. The apparatus of claim 8, wherein the hand-held device enables the person to initiate an emergency stop of the apparatus.

10. The apparatus of claim 1, wherein said movement detector comprises at least one element from the group consisting of an ultrasonic sensor, a camera, a sensor element to be mounted by the person, an angular sensor sensing an angle of a rope at which the person is to be suspended, a sensor sensing an amount of rope issued to the person, a sensor sensing a tension of the rope at which the person is suspended, and an optical sensor.

11. The apparatus of claim 1, wherein said arm arrangement comprises at least one vertical portion and at least one horizontal portion coupled with said at least one vertical portion, the person being suspendable at an end portion of said at least one horizontal portion.

12. The apparatus of claim 1, wherein said arm arrangement is height adjustable.

13. The apparatus of claim 1 wherein said arm arrangement comprises an adaptation mechanism to adapt a horizontal distance between a point where the person is suspended at the arm arrangement and said movable base to movements of the person.

14. The apparatus of claim 1, wherein at least a part of said arm arrangement is rotatable about a vertical axis.

15. The apparatus of claim 1, wherein the control unit is configured to control the apparatus based on a training course.

16. The apparatus of claim 1, wherein said movable base comprises a single base unit.

17. The apparatus of claim 1, further comprising an auxiliary arm arrangement, an orthesis device being mounted to the auxiliary arm arrangement.

* * * * *